US009174324B2

(12) United States Patent
Umemoto et al.

(10) Patent No.: US 9,174,324 B2
(45) Date of Patent: Nov. 3, 2015

(54) POLISHING APPARATUS WITH POLISHING HEAD COVER

(71) Applicant: EBARA CORPORATION, Tokyo (JP)

(72) Inventors: Masao Umemoto, Tokyo (JP); Tadakazu Sone, Tokyo (JP); Ryuichi Kosuge, Tokyo (JP); Hideo Aizawa, Tokyo (JP)

(73) Assignee: Ebara Corporation, Tokyo (JP)

( * ) Notice: Subject to any disclaimer, the term of this patent is extended or adjusted under 35 U.S.C. 154(b) by 0 days.

(21) Appl. No.: 14/167,941

(22) Filed: Jan. 29, 2014

(65) Prior Publication Data

US 2014/0213158 A1 Jul. 31, 2014

(30) Foreign Application Priority Data

Jan. 31, 2013 (JP) ..... 2013-017193

(51) Int. Cl.
*B24B 37/34* (2012.01)
*B24B 37/10* (2012.01)
*B24B 53/017* (2012.01)

(52) U.S. Cl.
CPC ..... *B24B 37/34* (2013.01); *B24B 37/105* (2013.01); *B24B 53/017* (2013.01)

(58) Field of Classification Search
CPC .... B24B 37/34; B24B 53/007; B24B 37/105; B24B 53/017; B08B 3/02
USPC ..... 451/65, 73, 364, 444, 451
See application file for complete search history.

(56) References Cited

U.S. PATENT DOCUMENTS

| | | | | |
|---|---|---|---|---|
| 6,206,760 | B1 * | 3/2001 | Chang et al. | 451/41 |
| 6,334,810 | B1 * | 1/2002 | Song et al. | 451/60 |
| 6,402,598 | B1 * | 6/2002 | Ahn et al. | 451/65 |
| 7,052,376 | B1 * | 5/2006 | Kao et al. | 451/65 |
| 7,785,175 | B2 * | 8/2010 | Doi et al. | 451/64 |
| 2009/0242125 | A1 * | 10/2009 | Paik et al. | 156/345.12 |
| 2012/0220196 | A1 * | 8/2012 | Maruyama et al. | 451/7 |
| 2014/0162536 | A1 * | 6/2014 | Umemoto et al. | 451/56 |

FOREIGN PATENT DOCUMENTS

| | | | |
|---|---|---|---|
| JP | 2007-245266 | A | 9/2007 |
| JP | 2008-296293 | A | 12/2008 |
| JP | 2009231450 | A * | 10/2009 |

* cited by examiner

*Primary Examiner* — Timothy V Eley
(74) *Attorney, Agent, or Firm* — Baker & Hostetler LLP

(57) ABSTRACT

A polishing apparatus is used for polishing a substrate such as a semiconductor. The polishing apparatus includes a polishing table configured to hold a polishing tool having a polishing surface, a polishing head having a top ring configured to press a substrate against the polishing surface, and a polishing head cover configured to cover the polishing head. The polishing apparatus further includes a first cleaning liquid supply mechanism configured to supply a cleaning liquid to an outer surface of the polishing head cover, and a second cleaning liquid supply mechanism configured to supply a cleaning liquid to an inner surface of the polishing head cover.

17 Claims, 7 Drawing Sheets

POLISHING APPARATUS WITH POLISHING HEAD COVER

CROSS REFERENCE TO RELATED APPLICATION

This application claims priority to Japanese Patent Application No. 2013-017193 filed Jan. 31, 2013, the entire contents of which are hereby incorporated by reference.

BACKGROUND OF THE INVENTION

1. Field of the Invention:

The present invention relates to a polishing apparatus, and more particularly to a polishing apparatus for polishing a surface of an object to be polished (a substrate) such as a wafer.

2. Description of the Related Art:

A chemical mechanical polishing (CMP) is a technology for polishing a surface of a wafer by a chemical action of a polishing liquid and a mechanical action of abrasive particles contained in the polishing liquid. Generally, a polishing apparatus for carrying out the "CMP" includes a polishing table for holding a polishing pad, a polishing head for pressing the wafer against the polishing pad, and a polishing liquid supply mechanism for supplying the polishing liquid (e.g., slurry) to the polishing pad. The polishing head includes a top ring for holding the wafer and pressing the wafer against a polishing surface of the polishing pad, and a top-ring operating mechanism for operating this top ring.

The wafer is pressed against the polishing surface of the polishing pad by the top ring, and the polishing table and the top ring are rotated in this state. The wafer is brought in sliding contact with the polishing surface of the polishing pad in the presence of the polishing liquid, so that the surface of the wafer is polished. After polishing of the wafer is terminated, an atomized fluid is supplied toward the polishing surface of the polishing pad from an atomizer to clean the polishing surface, as disclosed in Japanese laid-open patent publication No. 2008-296293.

When the surface of the substrate such as a wafer is polished while supplying the polishing liquid, the polishing liquid adheres to the polishing head including the top ring. The polishing liquid remaining on the polishing surface adheres to the polishing head also at the time of cleaning the polishing surface by the atomizer. The polishing liquid which has adhered to the polishing head is gradually dried, and may fall onto the polishing surface eventually. Such dried polishing liquid causes scratches on the surface, being polished, of the substrate.

SUMMARY OF THE INVENTION

The present invention has been made in view of the above drawbacks. It is therefore an object of the present invention to provide a polishing apparatus which can prevent the polishing liquid from adhering to the polishing head and prevent the dried polishing liquid from falling onto the polishing surface.

One aspect of the present invention is to provide a polishing apparatus comprising: a polishing table configured to hold a polishing tool having a polishing surface; a polishing head having a top ring configured to press a substrate against the polishing surface; a polishing head cover configured to cover the polishing head; a first cleaning liquid supply mechanism configured to supply a cleaning liquid to an outer surface of the polishing head cover; and a second cleaning liquid supply mechanism configured to supply a cleaning liquid to an inner surface of the polishing head cover.

In a preferred aspect of the present invention, the first cleaning liquid supply mechanism and the second cleaning liquid supply mechanism are mounted on the polishing head cover.

In a preferred aspect of the present invention, the first cleaning liquid supply mechanism is configured to supply the cleaning liquid onto the entire outer surface of the polishing head cover.

In a preferred aspect of the present invention, the second cleaning liquid supply mechanism is configured to supply the cleaning liquid onto the entire inner surface of the polishing head cover.

In a preferred aspect of the present invention, the second cleaning liquid supply mechanism includes a cleaning liquid passage configured to allow the cleaning liquid to flow, and a plurality of cleaning nozzles connected to the cleaning liquid passage; and the plurality of cleaning nozzles have distal end opening portions which are in contact with or close to the inner surface of the polishing head cover, and are configured to supply the cleaning liquid along the inner surface of the polishing head cover.

In a preferred aspect of the present invention, at least one of the outer surface and the inner surface of the polishing head cover is covered with a hydrophilic coating.

In a preferred aspect of the present invention, at least one of the outer surface and the inner surface of the polishing head cover is covered with a water repellent coating.

In a preferred aspect of the present invention, the outer surface of the polishing head cover has a convex portion or a concave portion extending in the horizontal direction, and the convex portion or the concave portion is located below the first cleaning liquid supply mechanism.

In a preferred aspect of the present invention, the inner surface of the polishing head cover has a convex portion or a concave portion extending in the horizontal direction, and the convex portion or the concave portion is located below the second cleaning liquid supply mechanism.

Other aspect of the present invention is to provide a polishing apparatus comprising: a polishing table configured to hold a polishing tool having a polishing surface; a polishing head having a top ring configured to press a substrate against the polishing surface; a polishing head cover configured to cover the polishing head; and cleaning liquid supply ports configured to supply a cleaning liquid to an outer surface of the polishing head cover; wherein the cleaning liquid supply ports are provided at an upper part of the polishing head cover and are arranged so as to surround the outer surface of the polishing head cover.

In a preferred aspect of the present invention, the cleaning liquid supply ports are arranged to supply the cleaning liquid onto the entire outer surface of the polishing head cover.

In a preferred aspect of the present invention, the outer surface of the polishing head cover is covered with a hydrophilic coating.

In a preferred aspect of the present invention, the outer surface of the polishing head cover is covered with a water repellent coating.

In a preferred aspect of the present invention, the outer surface of the polishing head cover has a convex portion or a concave portion extending in the horizontal direction, and the convex portion or the concave portion is located below the cleaning liquid supply ports.

Further, other aspect of the present invention is to provide a polishing apparatus comprising: a polishing table configured to hold a polishing tool having a polishing surface; a polishing head having a top ring configured to press a substrate against the polishing surface; a polishing head cover configured to cover the polishing head; and cleaning liquid supply ports configured to supply a cleaning liquid to an inner surface of the polishing head cover; wherein the cleaning liquid supply ports are provided at the inside of the polishing head cover and are arranged so as to surround the inner surface of the polishing head cover.

In a preferred aspect of the present invention, the cleaning liquid supply ports are arranged to supply the cleaning liquid onto the entire inner surface of the polishing head cover.

In a preferred aspect of the present invention, the cleaning liquid supply ports are in contact with or close to the inner surface of the polishing head cover, and are configured to supply the cleaning liquid along the inner surface of the polishing head cover.

In a preferred aspect of the present invention, the inner surface of the polishing head cover is covered with a hydrophilic coating.

In a preferred aspect of the present invention, the inner surface of the polishing head cover is covered with a water repellent coating.

In a preferred aspect of the present invention, the inner surface of the polishing head cover has a convex portion or a concave portion extending in the horizontal direction, and the convex portion or the concave portion is located below the cleaning liquid supply ports.

According to the present invention, the polishing head is housed in the polishing head cover. Therefore, the polishing head including the top ring can be protected from the polishing liquid by the polishing head cover. Since the polishing liquid adhering to the polishing head cover is washed away by a cleaning liquid, there is no fear that the dried polishing liquid falls onto the polishing surface. Therefore, according to the present invention, the occurrence of scratches on the surface of the substrate due to the dried polishing liquid can be prevented.

DETAILED DESCRIPTION

Figure 1:
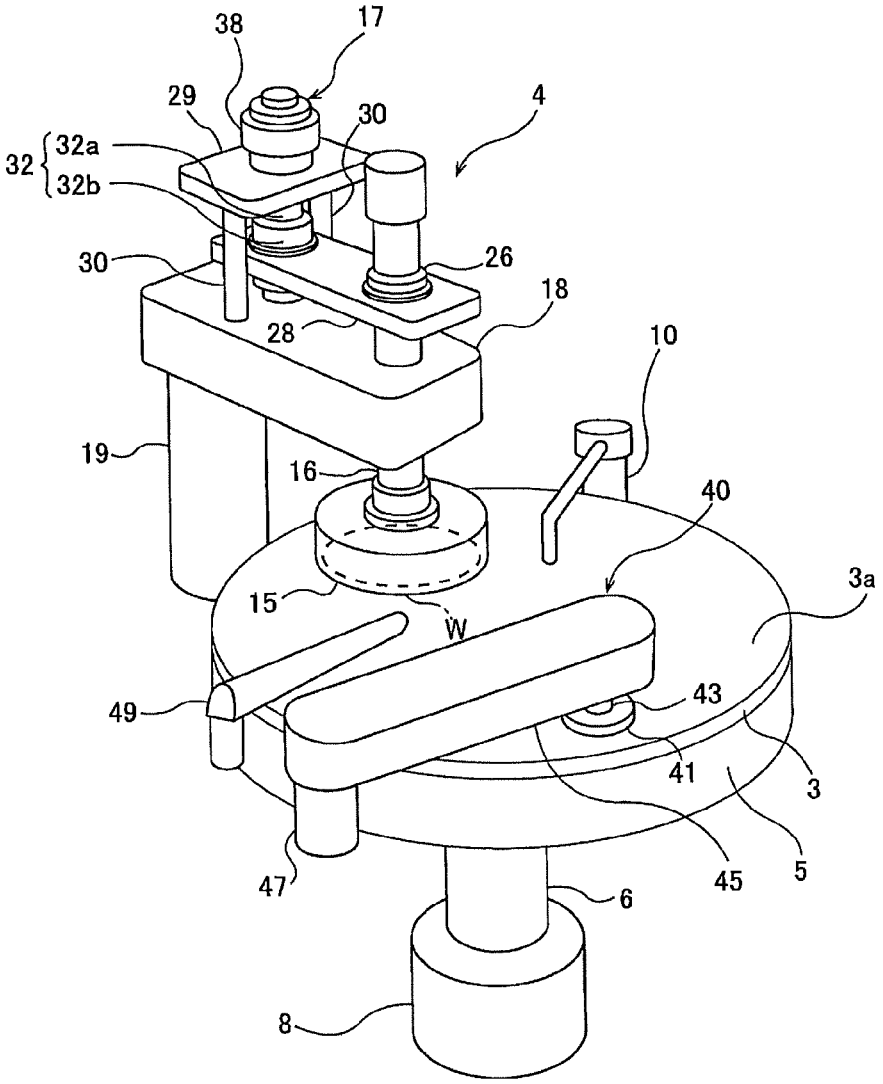
FIG. 1 is a perspective view of a polishing apparatus to which the present invention is applied.

Embodiments of a polishing apparatus according to the present invention will now be described in detail with reference to FIGS. 1 to 7. Identical or corresponding parts are denoted by identical reference numerals in FIGS. 1 to 7, and will not be described in duplication.

Figure 2:
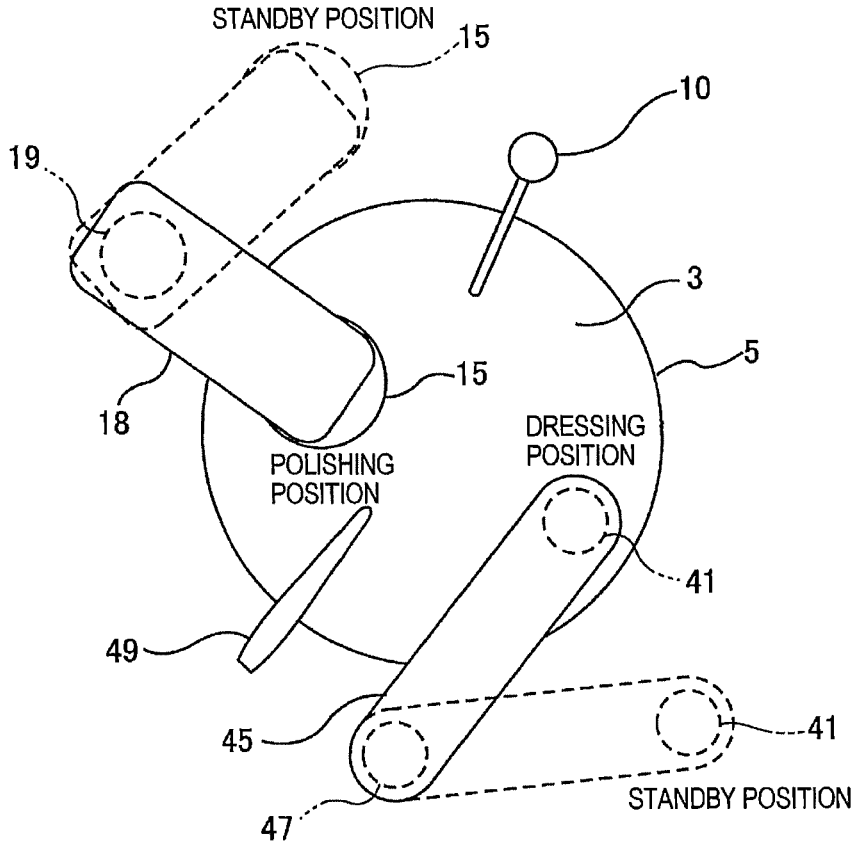
FIG. 2 is a plan view of the polishing apparatus shown in FIG. 1.

FIG. 1 is a perspective view of a polishing apparatus for polishing a surface of a substrate such as a wafer. FIG. 2 is a plan view of the polishing apparatus shown in FIG. 1. As shown in FIG. 1, the polishing apparatus includes a polishing table 5 for supporting a polishing pad 3 as a polishing tool, a polishing head 4 for holding and pressing the wafer W against the polishing pad 3 on the polishing table 5, and a polishing liquid supply mechanism 10 for supplying a polishing liquid (e.g., slurry) to the polishing pad 3. The polishing pad 3 is attached to an upper surface of the polishing table 5. The polishing pad 3, which is attached to the upper surface of the polishing table 5, has an upper surface serving as a polishing surface 3*a* for polishing the wafer W. As the polishing tool, a polishing cloth or a fixed abrasive may be used in place of the polishing pad 3.

The polishing table 5 is coupled via a table shaft 6 to a table motor 8 disposed below the polishing table 5, and the polishing table 5 and the polishing pad 3 are configured to be rotated about a common central axis by this table motor 8.

The polishing head 4 includes a top ring 15 for holding and pressing the wafer W against the polishing surface 3*a*, a top ring shaft 16 to which the top ring 15 is fixed, a top ring elevating mechanism 17 for elevating the top ring 15 through the top ring shaft 16, a top ring arm 18 on which the top ring elevating mechanism 17 is provided, and a top ring rotating mechanism (not shown in the drawings) for rotating the top ring 15 about its central axis through the top ring shaft 16. The top ring rotating mechanism is disposed in the top ring arm 18. The top ring elevating mechanism 17 and the top ring rotating mechanism constitute a top ring operating mechanism for operating the top ring 15.

The top ring 15 is secured to a lower end of the top ring shaft 16. The top ring 15 is configured to hold the wafer W on its lower surface by vacuum suction. The top ring arm 18 is coupled to a top ring swing shaft 19, and is configured to be swung about the top ring swing shaft 19. When the top ring arm 18 is swung, as shown in FIG. 2, the top ring 15 is configured to move between a polishing position located above the polishing table 5 and a standby position (shown by a dotted line) located radially outwardly of the polishing table 5.

As shown in FIG. 1, the top ring elevating mechanism 17 includes a bridge 28 that rotatably supports the top ring shaft 16 through a bearing 26, a ball screw 32 mounted to the bridge 28, a support base 29 supported by pillars 30, and a servomotor 38 provided on the support base 29. The support base 29 that supports the servomotor 38 is coupled to the top ring arm 18 via the pillars 30.

The ball screw 32 has a screw shaft 32*a* coupled to the servomotor 38 and a nut 32*b* that engages the screw shaft 32*a*. The top ring shaft 16 is elevated and lowered (i.e., vertically movable) together with the bridge 28. Therefore, when the servomotor 38 operates, the bridge 28 is moved vertically through the ball screw 32, whereby the top ring shaft 16 and the top ring 15 are moved vertically.

Polishing of the wafer W is performed as follows: The top ring 15 holding the wafer W is moved from the standby position to the polishing position. The top ring 15 and the polishing table 5 are rotated in the same direction, while a polishing liquid (i.e., slurry) is supplied onto the polishing pad 3 from the polishing liquid supply mechanism 10. In this state, the top ring 15 presses the wafer W against the polishing surface 3*a* of the polishing pad 3, and the wafer W and the polishing surface 3*a* are brought into sliding contact with each other. A surface of the wafer W is polished by a chemical action of the polishing liquid and a mechanical action of abrasive particles contained in the polishing liquid. Such polishing apparatus is referred to as a CMP (chemical mechanical polishing) apparatus.

The polishing apparatus further includes a dressing head 40 for dressing (or conditioning) the polishing surface 3*a* of the polishing pad 3. The dressing head 40 includes a dresser 41 that is brought into sliding contact with the polishing pad 3, a dresser shaft 43 to which the dresser 41 is fixed, a dresser arm 45 for holding the dresser shaft 43, and a dresser rotating mechanism (not shown in the drawings) for rotating the dresser 41 through the dresser shaft 43. The dresser rotating mechanism is disposed in the dresser arm 45. Abrasive particles (not shown in the drawings) such as diamond particles are fixed to the lower surface of the dresser 41, and these abrasive particles constitute a dressing surface for dressing the polishing surface 3*a*.

The dresser arm 45 is coupled to a dresser swing shaft 47, and is configured to be swung about the dresser swing shaft 47. When the dresser arm 45 is swung, the dresser 41 is oscillated on the polishing surface 3*a* in a radial direction of the polishing table 5. The dresser 41 is rotated while the dresser 41 is oscillated on the polishing surface 3*a* of the polishing pad 3, thereby scraping off the polishing pad 3 slightly to dress the polishing surface 3*a*. Further, as shown in FIG. 2, the dresser 41 is moved between a dressing position located above the polishing table 5 and a standby position (shown by a dotted line) located outwardly of the polishing table 5 by rotation of the dresser swing shaft 47.

The polishing apparatus further includes an atomizer 49 for cleaning the polishing surface 3*a* by spraying an atomized cleaning fluid to the polishing surface 3*a* on the polishing pad 3. The atomizer 49 extends in the radial direction of the polishing pad 3 (or the polishing table 5). The cleaning fluid is composed of a fluid mixture of a cleaning liquid (usually pure water) and a gas (e.g., an inert gas such as a nitrogen gas) or only a cleaning liquid. By spraying such cleaning fluid to the polishing surface 3*a*, polishing debris and the abrasive particles contained in the polishing liquid remaining on the polishing surface 3*a* of the polishing pad 3 are removed.

Figure 3:
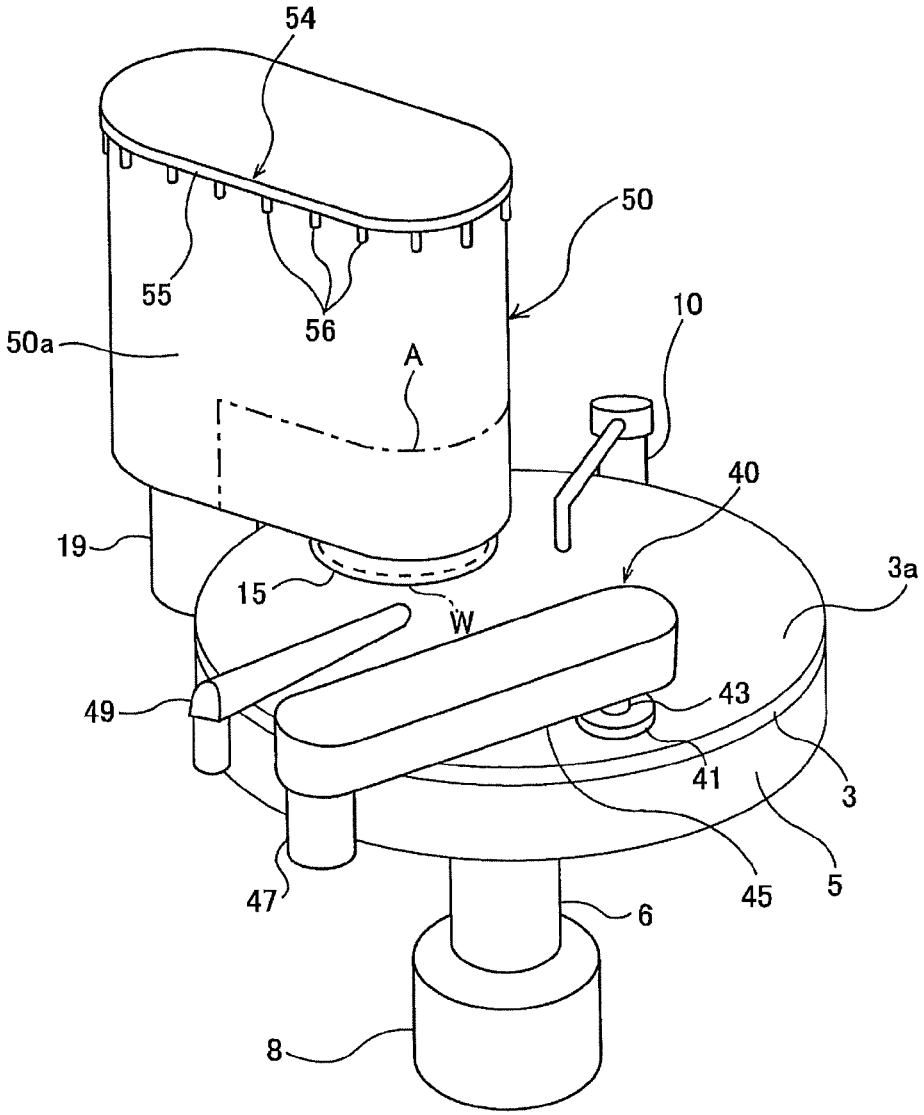
FIG. 3 is a perspective view showing a polishing apparatus having a polishing head cover for covering a polishing head according to an embodiment of the present invention.

FIG. 3 is a view showing a polishing apparatus having a polishing head cover 50 for covering the polishing head 4 according to an embodiment of the present invention. As shown in FIG. 3, the polishing head 4 is almost entirely covered by the polishing head cover 50. The polishing head cover 50 has an oval-shaped horizontal cross section and a lower open end. The polishing head cover 50 may have a round-shaped horizontal cross section or a polygonal-shaped horizontal cross section such as a square-shaped horizontal cross section. The polishing head cover 50 houses the top ring shaft 16, the top ring arm 18, the top ring rotating mechanism (not shown in the drawings), and the top ring elevating mechanism 17 therein. Further, the polishing head cover 50 has such a shape as to cover the upper part of the top ring 15. Therefore, it is possible to prevent the polishing liquid from entering the upper part of the top ring 15 and to prevent the polishing liquid from adhering to the polishing head 4 including the top ring elevating mechanism 17.

A first cleaning liquid supply mechanism 54 for supplying the cleaning liquid to an outer circumferential surface 50*a* of the polishing head cover 50 is arranged at the upper part of the polishing head cover 50. The first cleaning liquid supply mechanism 54 includes an annular cleaning liquid passage (i.e., a first cleaning liquid passage) 55 for allowing the cleaning liquid to pass therethrough, and a plurality of cleaning nozzles (i.e., first cleaning nozzles) 56 connected to the cleaning liquid passage 55. The plurality of cleaning nozzles 56 constitute cleaning liquid supply ports. The cleaning liquid passage 55 and the cleaning nozzles 56 are attached to an upper end of the polishing head cover 50. Pure water is preferably used as a cleaning liquid.

The cleaning liquid passage 55 extends along a circumferential direction of the outer circumferential surface 50*a* so as to surround the outer circumferential surface 50*a*. The cleaning nozzles 56 are arranged at equal intervals over the entire circumference of the outer circumferential surface 50*a*. The cleaning liquid is supplied to the cleaning liquid passage 55 from a cleaning liquid supply line (not shown in the drawings). The cleaning liquid flowing through the cleaning liquid passage 55 is supplied onto the outer circumferential surface 50*a* of the polishing head cover 50 from the cleaning nozzles 56. It is preferable that the cleaning nozzle 56 is a spray nozzle which can spray the cleaning liquid over a wide area of the outer circumferential surface 50*a*.

When the top ring 15 is in the standby position, (i.e., the top ring 15 is not positioned above the polishing surface 3*a*), the cleaning liquid is sprayed toward the outer circumferential surface 50*a*. It is preferable that distal end opening portions of the cleaning nozzles 56 are arranged in contact with or close to the outer circumferential surface 50*a* so as to supply the cleaning liquid along the outer circumferential surface 50*a*. The cleaning liquid flows downward over the entire circumference of the outer circumferential surface 50*a*, and washes away the polishing liquid adhered to the outer circumferential surface 50*a*. Therefore, the polishing liquid does not remain on the polishing head cover 50, and thus the dried polishing liquid can be prevented from falling onto the polishing surface 3*a* of the polishing pad 3.

In order to form a liquid film having a uniform thickness of the cleaning liquid on the outer circumferential surface 50*a*, it is preferable to cover the outer circumferential surface 50*a* of the polishing head cover 50 with a hydrophilic coating. An example of such hydrophilic coating includes a coat comprising a mixture of a silicon-based organic compound and fluorine. An example of a method for applying the hydrophilic coating onto the outer circumferential surface 50*a* includes a method for applying a hydrophilic material to the outer circumferential surface 50*a* and applying heat treatment to the hydrophilic material on the outer circumferential surface 50*a*. By covering the outer circumferential surface 50*a* with the hydrophilic coating, the cleaning liquid spreads over the entire circumference of the outer circumferential surface 50*a* with the cleaning liquid sticking to the outer circumferential surface 50*a*, thus forming the liquid film having the uniform thickness on the outer circumferential surface 50*a*.

The outer circumferential surface 50*a* of the polishing head cover 50 may be covered with a water repellent coating in place of the hydrophilic coating. An example of a method for applying the water repellent coating onto the outer circumferential surface 50*a* includes a method for applying a water repellent material onto the outer circumferential surface 50*a* and applying heat treatment to the water repellent material on the outer circumferential surface 50*a*. By covering the outer circumferential surface 50*a* with the water repellent coating, the polishing liquid which has adhered to the outer circumferential surface 50*a* at the time of polishing the wafer W is aggregated, and flows down in a streaky manner. Thus, there is no fear that the polishing liquid is dried while adhering to the outer circumferential surface 50*a*. As a result, the dried polishing liquid is prevented from falling onto the polishing surface 3*a* of the polishing pad 3.

Figure 4A:
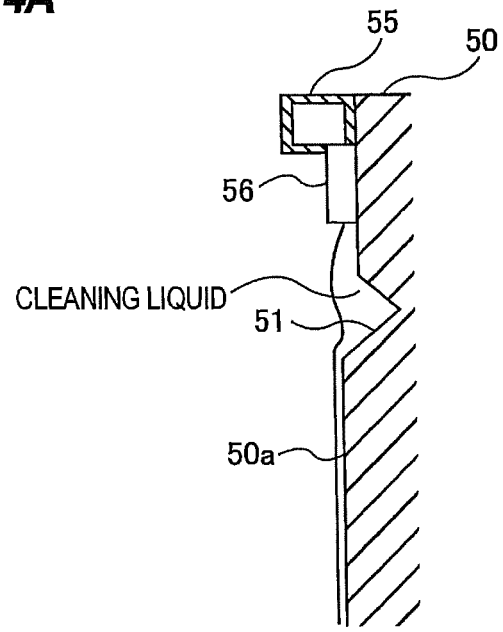
FIG. 4A is an enlarged view showing a groove provided in an outer circumferential surface of the polishing head cover.
Figure 4B:
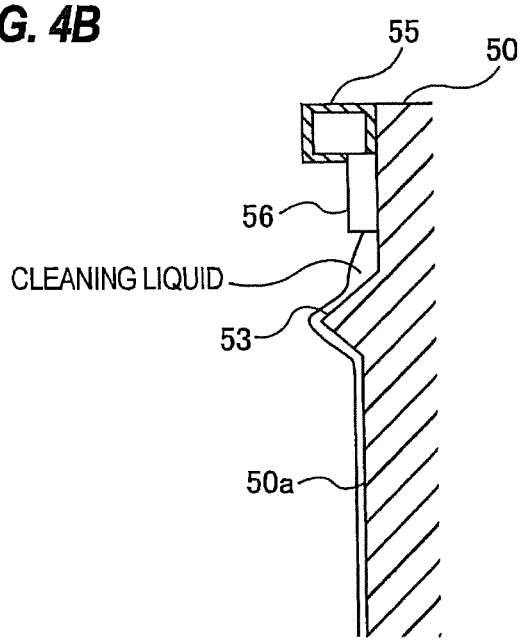
FIG. 4B is an enlarged view showing a dam provided on the outer circumferential surface of the polishing head cover.

As shown in FIG. 4A and FIG. 4B, there may be provided a groove (concave portion) 51 or a dam (convex portion) 53 extending in the horizontal direction in or on the outer circumferential surface 50*a* of the polishing head cover 50. The groove 51 or the dam 53 is located below the cleaning nozzles 56, and extends horizontally over the entire circumference of the outer circumferential surface 50*a*. The groove 51 and the dam 53 have a triangular-shaped section. The cleaning liquid supplied on the outer circumferential surface 50*a* from the cleaning nozzle 56 spreads horizontally in the groove 51 or on the dam 53, and then flows down, thus forming a downward flow of the cleaning liquid having a wide width. In order to maintain this wide downward flow, it is preferable that the hydrophilic coating is formed on the outer circumferential surface 50*a*. The cleaning liquid flows down on the outer circumferential surface 50*a* while maintaining the wide flow, and forms the liquid film having the uniform thickness on the outer circumferential surface 50*a*.

In FIG. 4A and FIG. 4B, the cleaning liquid passage 55 is a square tube, but is not limited to a particular shape. For example, the cleaning liquid passage 55 may be a tubular passage. The groove 51 shown in FIG. 4A or the dam 53 shown in FIG. 4B may be provided in or on the outer circumferential surface 50*a* covered with the water repellent coating.

In order to reduce the consumption of the cleaning liquid, it is preferable to reuse the cleaning liquid after recovering the used cleaning liquid and removing foreign matters from the recovered cleaning liquid. It is preferable to remove the cleaning liquid from the polishing head cover 50 by blowing a purge gas (such as a nitrogen gas) onto the polishing head cover 50 located at the standby position so that the cleaning liquid supplied to the polishing head cover 50 does not fall onto the polishing pad 3.

Figure 5A:
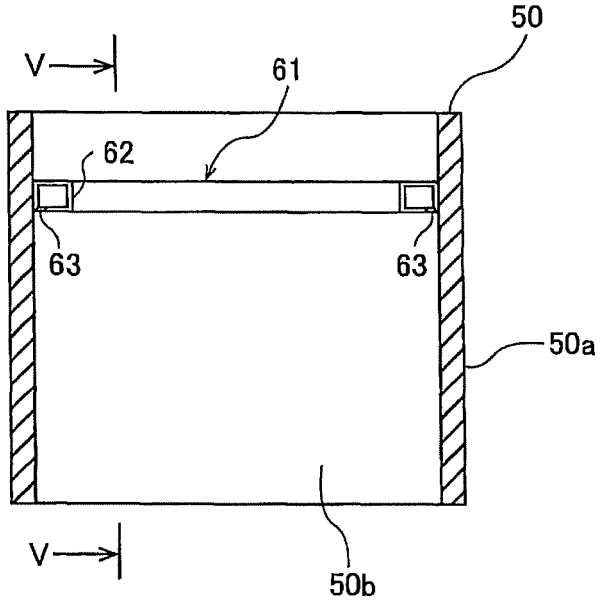
FIG. 5A is a view showing an inner circumferential surface of the polishing head cover cut along an alternate long and short dash line indicated by a letter "A" in FIG. 3.
Figure 5B:
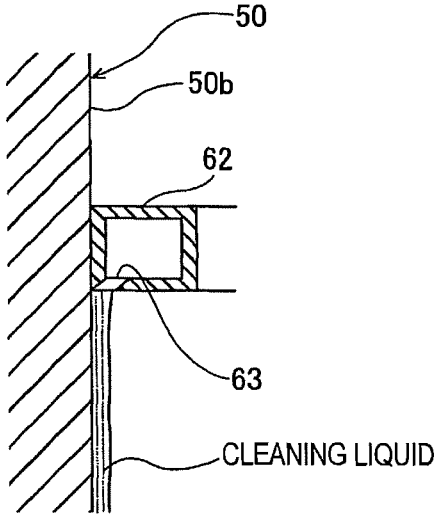
FIG. 5B is a cross-sectional view taken along line V-V in FIG. 5A.

FIG. 5A is a view showing the inner circumferential surface of the polishing head cover 50 cut along an alternate long and short dash line indicated by a letter "A" in FIG. 3, and FIG. 5B is a cross-sectional view taken along line V-V in FIG. 5A. As shown in FIG. 5A and FIG. SB, there is provided a second cleaning liquid supply mechanism 61 for supplying the cleaning liquid to an inner circumferential surface 50*b* of the polishing head cover 50. The reason for providing the second cleaning liquid supply mechanism 61 on the inside of the polishing head cover 50 is as follows: As shown in FIG. 1, the top ring 15 is configured so as to move up and down with respect to the top ring arm 18 by the top ring elevating mechanism 17. Since the polishing head cover 50 is formed so as to surround the top ring 15, when the top ring 15 located at the raised position rotates in the polishing head cover 50, the polishing liquid is scattered and adheres to the inner circumferential surface 50*b* of the polishing head cover 50. Therefore, in order to remove the polishing liquid from the inner circumferential surface 50*b* of the polishing head cover 50, the cleaning liquid is supplied from the second cleaning liquid supply mechanism 61 to the inner circumferential surface 50*b*.

As shown in FIG. 5A, the second cleaning liquid supply mechanism 61 includes a cleaning liquid passage (i.e., a second cleaning liquid passage) 62 for allowing the cleaning liquid to pass therethrough, and a plurality of cleaning nozzles (i.e., second cleaning nozzles) 63 connected to the cleaning liquid passage 62. The plurality of cleaning nozzles 63 constitute cleaning liquid supply ports. The cleaning liquid passage 62 is fixed to the inner circumferential surface 50*b*, and extends along the circumferential direction of the inner circumferential surface 50*b*. The cleaning nozzles 63 are arranged at the same height as the raised position of the top ring 15, or above the raised position of the top ring 15. As shown in FIG. 5B, the cleaning nozzles 63 comprise through-holes formed at the bottom of the cleaning liquid passage 62. The cleaning nozzles 63 may be formed separately from the cleaning liquid passage 62. The cleaning nozzles 63 are arranged at equal intervals along the circumferential direction of the inner circumferential surface 50*b*.

The cleaning liquid is supplied to the cleaning liquid passage 62 from the above-described cleaning liquid supply line (not shown in the drawings). The cleaning liquid flowing through the cleaning liquid passage 62 is supplied to the inner circumferential surface 50*b* of the polishing head cover 50 from the respective cleaning nozzles 63. In order to prevent the scattering of the cleaning liquid when the cleaning liquid ejected from the cleaning nozzles 63 hits the inner circumferential surface 50*b*, distal end opening portions of the cleaning nozzles 63 are arranged in contact with or close to the inner circumferential surface 50*b*. Further, the cleaning nozzles 63 are inclined with respect to the inner circumferential surface 50*b* so that the distal end opening portions of the cleaning nozzles 63 face the inner circumferential surface 50*b*. By using such cleaning nozzles 63, the cleaning liquid flows out from the cleaning nozzles 63 along the inner circumferential surface 50*b* without being scattered, thus forming a liquid film having a uniform thickness on the inner circumferential surface 50*b*. The cleaning liquid passage 62 and the cleaning nozzle 63 shown in FIG. 5B may be applied to the above-described first cleaning liquid supply mechanism 54.

In order to form the liquid film having the uniform thickness of the cleaning liquid on the inner circumferential surface 50*b*, it is preferable to cover the inner circumferential surface 50*b* of the polishing head cover 50 with the hydrophilic coating. By covering the inner circumferential surface 50*b* with the hydrophilic coating, the cleaning liquid spreads over the entire inner circumferential surface 50*b* with the cleaning liquid sticking to the inner circumferential surface 50*b*, thus forming the liquid film having the uniform thickness on the inner circumferential surface 50*b*.

The inner circumferential surface 50*b* of the polishing head cover 50 may be covered with the water repellent coating in place of the hydrophilic coating. By covering the inner circumferential surface 50*b* with the water repellent coating, the polishing liquid which has adhered to the inner circumferential surface 50*b* is aggregated, and flows down in a streaky manner. Thus, there is no fear that the polishing liquid is dried while adhering to the inner circumferential surface 50*b*. As a result, the dried polishing liquid is prevented from falling onto the polishing surface 3*a* of the polishing pad 3.

Figure 6A:
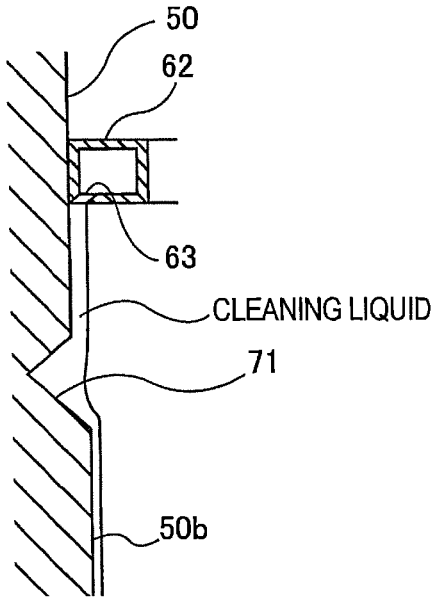
FIG. 6A is an enlarged view showing a groove provided in the inner circumferential surface of the polishing head cover.
Figure 6B:
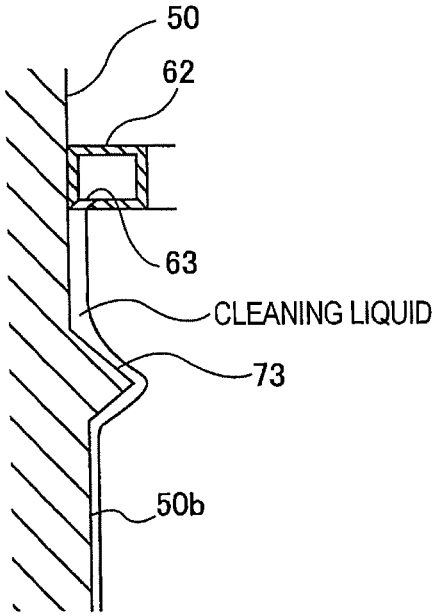
FIG. 6B is an enlarged view showing a dam provided on the inner circumferential surface of the polishing head cover.

As shown in FIG. 6A and FIG. 6B, there may be provided a groove (concave portion) 71 or a dam (convex portion) 73 extending in the horizontal direction in or on the inner circumferential surface 50*b* of the polishing head cover 50. The groove 71 or the dam 73 is located below the cleaning nozzles 63, and extends horizontally over the entire inner circumferential surface 50*b*. The groove 71 and the dam 73 have a triangular-shaped section. The cleaning liquid supplied on the inner circumferential surface 50*b* from the cleaning nozzle 63 spreads horizontally in the groove 71 or on the dam 73, and then flows down, thus forming a downward flow of the cleaning liquid having a wide width. In order to maintain this wide downward flow, it is preferable that the hydrophilic coating is formed on the inner circumferential surface 50*b*. The cleaning liquid flows down on the inner circumferential surface 50*b* while maintaining the wide flow, and forms the liquid film having the uniform thickness on the inner circumferential surface 50*b*.

In order to prevent the scattering of the cleaning liquid itself supplied to the inner circumferential surface 50*b* of the polishing head cover 50, it is preferable to reduce a flow rate of the cleaning liquid supplied from the cleaning nozzles 63. In this case also, the cleaning liquid spreads in the horizontal direction by the groove 71 or the dam 73, and thus the liquid film having the uniform thickness can be formed on the inner circumferential surface 50*b*.

In FIG. 6A and FIG. 6B, the cleaning liquid passage 62 is a square tube, but is not limited to a particular shape. For example, the cleaning liquid passage 62 may be a tubular passage. The groove 71 shown in FIG. 6A or the dam 73 shown in FIG. 6B may be provided in or on the inner circumferential surface 50*b* covered with the water repellent coating.

Figure 7:
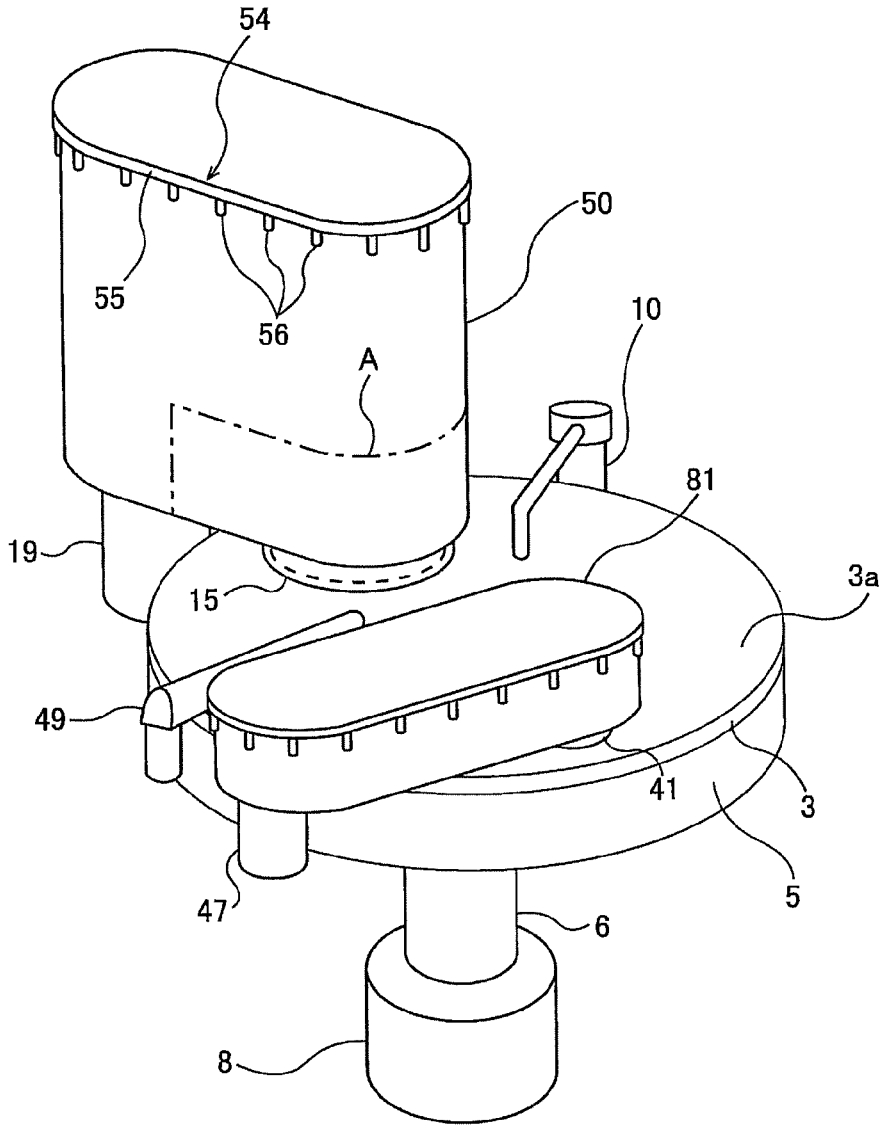
FIG. 7 is a perspective view showing a polishing apparatus having a dressing head cover for covering a dressing head according to an embodiment of the present invention.

The polishing head cover 50 described with reference to FIGS. 3 through 6B, may be applied to the dresser head 40. FIG. 7 is a view showing an example of mounting a dressing head cover 81 to the dressing head 40. The structure of the dressing head cover 81 is the same as the polishing head cover 50, and will not be described in duplication.

The previous description of embodiments is provided to enable a person skilled in the art to make and use the present invention. Moreover, various modifications to these embodiments will be readily apparent to those skilled in the art, and the generic principles and specific examples defined herein may be applied to other embodiments. Therefore, the present invention is not intended to be limited to the embodiments described herein but is to be accorded the widest scope as defined by limitation of the claims and equivalents.

What is claimed is:

1. A polishing apparatus comprising:

a polishing table configured to hold a polishing tool having a polishing surface;

a polishing head having a top ring configured to press a substrate against the polishing surface;

a polishing head cover configured to cover the polishing head;

a first cleaning liquid supply mechanism configured to supply a cleaning liquid to an outer surface of the polishing head cover; and a second cleaning liquid supply mechanism configured to supply a cleaning liquid to an inner surface of the polishing head cover.

2. The polishing apparatus according to claim 1, wherein the first cleaning liquid supply mechanism and the second cleaning liquid supply mechanism are mounted on the polishing head cover.

3. The polishing apparatus according to claim 1, wherein the second cleaning liquid supply mechanism includes a cleaning liquid passage configured to allow the cleaning liquid to flow, and a plurality of cleaning nozzles connected to the cleaning liquid passage; and the plurality of cleaning nozzles have distal end opening portions which are in contact with or close to the inner surface of the polishing head cover, and are configured to supply the cleaning liquid along the inner surface of the polishing head cover.

4. The polishing apparatus according to claim 1, wherein at least one of the outer surface and the inner surface of the polishing head cover is covered with a hydrophilic coating.

5. The polishing apparatus according to claim 1, wherein at least one of the outer surface and the inner surface of the polishing head cover is covered with a water repellent coating.

6. The polishing apparatus according to claim 1, wherein the outer surface of the polishing head cover has a convex portion or a concave portion extending in the horizontal direction, and the convex portion or the concave portion is located below the first cleaning liquid supply mechanism.

7. The polishing apparatus according to claim 1, wherein the inner surface of the polishing head cover has a convex portion or a concave portion extending in the horizontal direction, and the convex portion or the concave portion is located below the second cleaning liquid supply mechanism.

8. A polishing apparatus comprising:

a polishing table configured to hold a polishing tool having a polishing surface;

a polishing head having at least:

a top ring configured to hold and press a substrate against the polishing surface, a top ring shaft to which the top ring is fixed, a top ring elevating mechanism to elevate the top ring through the top ring shaft, and a top ring arm on which the top ring elevating mechanism is provided, a polishing head cover configured to cover the top ring shaft, the top ring elevating mechanism, the top ring arm, and an upper part of the top ring; and cleaning liquid supply ports configured to supply a cleaning liquid to an outer surface of the polishing head cover;

wherein the cleaning liquid supply ports are provided at an upper part of the polishing head cover and are arranged so as to surround the outer surface of the polishing head cover.

9. The polishing apparatus according to claim 8, wherein the outer surface of the polishing head cover is covered with a hydrophilic coating.

10. The polishing apparatus according to claim 8, wherein the outer surface of the polishing head cover is covered with a water repellent coating.

11. The polishing apparatus according to claim 8, wherein the outer surface of the polishing head cover has a convex portion or a concave portion extending in the horizontal direction, and the convex portion or the concave portion is located below the cleaning liquid supply ports.

12. A polishing apparatus comprising:

a polishing table configured to hold a polishing tool having a polishing surface;

a polishing head having a top ring configured to press a substrate against the polishing surface;

a polishing head cover configured to cover the polishing head; and cleaning liquid supply ports configured to supply a cleaning liquid to an inner surface of the polishing head cover;

wherein the cleaning liquid supply ports are provided at the inside of the polishing head cover and are arranged so as to be along the inner surface of the polishing head cover.

13. The polishing apparatus according to claim 12, wherein the cleaning liquid supply ports are in contact with or close to the inner surface of the polishing head cover, and are configured to supply the cleaning liquid along the inner surface of the polishing head cover.

14. The polishing apparatus according to claim 12, wherein the inner surface of the polishing head cover is covered with a hydrophilic coating.

15. The polishing apparatus according to claim 12, wherein the inner surface of the polishing head cover is covered with a water repellent coating.

16. The polishing apparatus according to claim 12, wherein the inner surface of the polishing head cover has a convex portion or a concave portion extending in the horizontal direction, and the convex portion or the concave portion is located below the cleaning liquid supply ports.

17. The polishing apparatus according to claim 12, wherein the cleaning liquid supply ports are arranged at equal intervals along the inner surface of the polishing head cover.

* * * * *